US009345307B2

(12) United States Patent
Eberlein et al.

(10) Patent No.: US 9,345,307 B2
(45) Date of Patent: May 24, 2016

(54) DISPENSER CAP WITH CLUTCH MECHANISM

(71) Applicant: HCT Asia Ltd., Central (HK)

(72) Inventors: David Eberlein, Los Angeles, CA (US); Tom Bentley, London (GB)

(73) Assignee: HCT ASIA LTD., Central (HK)

( * ) Notice: Subject to any disclaimer, the term of this patent is extended or adjusted under 35 U.S.C. 154(b) by 130 days.

(21) Appl. No.: 14/247,859

(22) Filed: Apr. 8, 2014

(65) Prior Publication Data

US 2014/0301764 A1 Oct. 9, 2014

Related U.S. Application Data

(60) Provisional application No. 61/809,797, filed on Apr. 8, 2013.

(51) Int. Cl.
*A45D 40/26* (2006.01)
*A45D 34/04* (2006.01)

(52) U.S. Cl.
CPC ..... *A45D 40/26* (2013.01); *A45D 34/045* (2013.01); *A45D 34/046* (2013.01); *A45D 40/265* (2013.01); *A45D 40/267* (2013.01)

(58) Field of Classification Search
CPC combination set(s) only.
See application file for complete search history.

(56) References Cited

U.S. PATENT DOCUMENTS 3,837,749 A * 9/1974 Spatz ..... A45D 33/00 401/130

* cited by examiner

*Primary Examiner* — David Walczak
(74) *Attorney, Agent, or Firm* — Seager, Tufte & Wickhem LLP

(57) ABSTRACT

A cap assembly having a clutch mechanism which permits independent rotation of a stemmed applicator when the cap is in a closed position and prevents rotation when the cap is removed. The cap assembly in combination with a housing, particularly for cosmetics applications, is also disclosed. The stemmed applicator may have shaft having a non-circular cross-section, when taken perpendicular to its longitudinal axis.

20 Claims, 3 Drawing Sheets

DISPENSER CAP WITH CLUTCH MECHANISM

CROSS REFERENCE TO RELATED APPLICATION

This application claims priority to U.S. Provisional Patent Application No. 61/809,797, filed on Apr. 8, 2013, which is hereby incorporated by reference in its entirety.

FIELD

This disclosure relates to product dispensers. Particularly, the disclosure relates to product dispensers for use with stemmed applicators. More particularly, this disclosure relates to product dispensers employing a clutch mechanism between a cap of the dispenser and the stemmed applicator to allow selective rotation of the stemmed applicator with the cap.

BACKGROUND

Many types of products are sold in a dispenser including a reservoir for housing the product, a cap for sealing the reservoir when not in use, and a stemmed applicator affixed to the cap such that the applicator can be reloaded by inserting the stemmed applicator into the reservoir. Typically, the cap and the housing are mated via threaded arrangement to facilitate opening and closing the dispenser. Such an apparatus is commonly seen in the cosmetics industry, particularly for use with lip gloss, mascara, and other products, although this disclosure is not limited to these uses. In some instances, a wiper is provided in the housing for wiping excess product from the applicator shaft. In these cases, the wiper defines an aperture mated to the applicator shaft. Because the shaft rotates with the cap during opening and closing, the cross-sectional shape of the shaft has been limited to substantially circular cross-sections.

Applicants have created a dispenser with shafts not limited to circular cross-sections.

SUMMARY

Some embodiments provide a dispenser apparatus comprising a base apparatus comprising a housing defining a reservoir for holding product, and defining an opening, a wiper apparatus within the opening; a cap assembly which is removably coupled to the base apparatus, the cap assembly comprising an outer cap, an inner cap affixed to an inner surface of the outer cap; a stemmed applicator assembly further comprising a shaft and an applicator, a clutch mechanism between the inner cap and the stemmed applicator; wherein the clutch mechanism is engaged when the cap assembly is decoupled from the base apparatus to prevent rotation of the stemmed applicator with respect to the outer cap, and wherein the clutch mechanism is disengaged when the cap assembly is coupled to the base apparatus to permit independent rotation of the outer cap with respect to the shaft of the stemmed applicator.

In some embodiments, the shaft of the stemmed applicator has a non-circular cross-section taken substantially perpendicular to a longitudinal axis of the shaft. In some embodiments, the cross-section of the shaft has a shape selected from a regular polygon, an irregular polygon, or a non-polygonal shape. In some embodiments, the shaft of the stemmed applicator has a cross-section, taken perpendicular to a longitudinal axis of the shaft, having a shape selected from a triangle, square, rectangle, pentagon, hexagon, heptagon, octagon or trapezoid. Other non-traditional cross-sectional shapes may also be employed.

In some embodiments, the clutch mechanism is a friction clutch. In some embodiments, the clutch mechanism is a cone clutch.

In some embodiments, the inner cap comprises a driving member of the clutch mechanism, and the stemmed applicator assembly comprises, at a proximal end, a driven member of the clutch mechanism. In some embodiments, the driving member and the driven member comprise mated and engaging toothed members.

In some embodiments, the cap assembly is further provided with at least one spring urging the driving member and driven member towards each other when the base assembly and cap assembly are decoupled. In some embodiments, the driven member is urged towards the driven member. In some embodiments, the driving member is urged toward the driving member.

In some embodiments, the base apparatus and the cap assembly are threaded to facilitate closing and opening of the dispenser, and the base apparatus further comprises an upper lip for engaging the stemmed applicator assembly such that the clutch is disengaged prior to threaded coupling of the base apparatus and the cap assembly.

Some embodiments provide a cap assembly adapted for removable coupling to a base apparatus, the cap assembly comprising an outer cap, an inner cap affixed to an inner surface of the outer cap; a stemmed applicator assembly further comprising a shaft, a clutch mechanism between the inner cap and the stemmed applicator assembly; wherein the clutch mechanism is engaged when the cap assembly is decoupled from the base apparatus to prevent rotation of the stemmed applicator with respect to the outer cap, and wherein the clutch mechanism is disengaged when the cap assembly is coupled to the base apparatus to permit independent rotation of the outer cap with respect to the shaft of the stemmed applicator.

In some embodiments, the shaft of the stemmed applicator has a non-circular cross-section taken substantially perpendicular to a longitudinal axis of the shaft. In some embodiments, the cross-section of the shaft has a shape selected from a regular polygon, an irregular polygon, or a non-polygonal shape. In some embodiments, the shaft of the stemmed applicator has a cross-section, taken perpendicular to a longitudinal axis of the shaft, having a shape selected from a triangle, square, rectangle, pentagon, hexagon, heptagon, octagon or trapezoid. Other non-traditional cross-sectional shapes may also be employed.

In some embodiments, the clutch mechanism is a friction clutch. In some embodiments, the clutch mechanism is a cone clutch.

In some embodiments, the inner cap comprises a driving member of the clutch mechanism, and the stemmed applicator assembly comprises, at a proximal end, a driven member of the clutch mechanism. In some embodiments, the driving member and the driven member comprise mated and engaging toothed members.

In some embodiments, the cap assembly is further provided with at least one spring urging the driving member and driven member towards each other when the base assembly and cap assembly are decoupled. In some embodiments, the driven member is urged towards the driven member. In some embodiments, the driving member is urged toward the driving member.

In some embodiments, the base apparatus and the cap assembly are threaded to facilitate closing and opening of the dispenser, and the base apparatus further comprises an upper lip for engaging the stemmed applicator assembly such that the clutch is disengaged prior to threaded coupling of the base apparatus and the cap assembly.

BRIEF DESCRIPTION OF THE DRAWINGS

The drawings submitted herewith show some embodiments or features of some embodiments encompassed by the disclosure. The drawings are meant to be illustrative and are not intended to be limiting. Like reference numerals refer to like elements through the drawings.

DETAILED DESCRIPTION

For ease of reference, the description herein relates to lip gloss or mascara applicators. Those of skill in the art will readily recognize that the concepts disclosed herein are not limited to lip gloss or mascara applications, but readily adaptable to any application involving a stemmed applicator.

For a lip gloss or mascara to function properly, a wiper piece, which remains static relative to the bottle, must fit closely to the stem's cross section, matching the shape of it. The wiper piece defines a hole through which the applicator stem passes when being inserted or removed from the bottle. This close fit allows excess product to be wiped from the stem and applicator to reduce mess and overloading. Almost every lip gloss and mascara use a threaded closure where the cap and base (containing the reservoir) must be rotated relative to one another to remove and replace the cap and stemmed applicator assembly from the base assembly. Thus, since the stem must rotate with the cap relative to the base during cap assembly removal and replacement, the typical choice for stem shape and mated wiper-hole shape is a circle. This is the only shape that allows for a close fit between the wiper and the stem throughout a full 360° rotation (about its longitudinal axis). For example, with a square stem mated even to a square wiper-hole, rotation of the shaft would not mate with the hole throughout a 360° rotation. Providing a hole large enough to accommodate such rotation would create undesirable leaks. Described herein is an applicator device which allows for a close fitting wiper-hole for a variety of circular and non-circular cross-sectioned stemmed applicators.

One option to allow for non-circular stems would be to allow the stem to rotate freely relative to the cap to which it is attached. When unscrewing the cap, the stem translates vertically with the cap, but would not rotate with it. This, however, results in a major undesirable side effect in that the stemmed applicator would potentially rotate during product application.

To prevent this undesirable rotation during application, a clutch mechanism is provided in the cap, between the cap and the stemmed applicator. Basically, the clutch is disengaged as the cap is pushed onto the neck of the bottle for and during threading (closing) of the cap. In this manner, the cap and the stemmed applicator rotate independently of one another which allows the wiper to maintain close contact with the shaft. When unscrewing the cap for product use, the stemmed applicator is again allowed to rotate independently of the cap, until a clutch engages thereby locking the stemmed applicator and cap for rotation together. In some embodiments, a spring urges a driving member and a driven member of the clutch when the cap is free of the bottle's threads, thereby engaging the clutch to lock the shaft in place.

Figure 1:
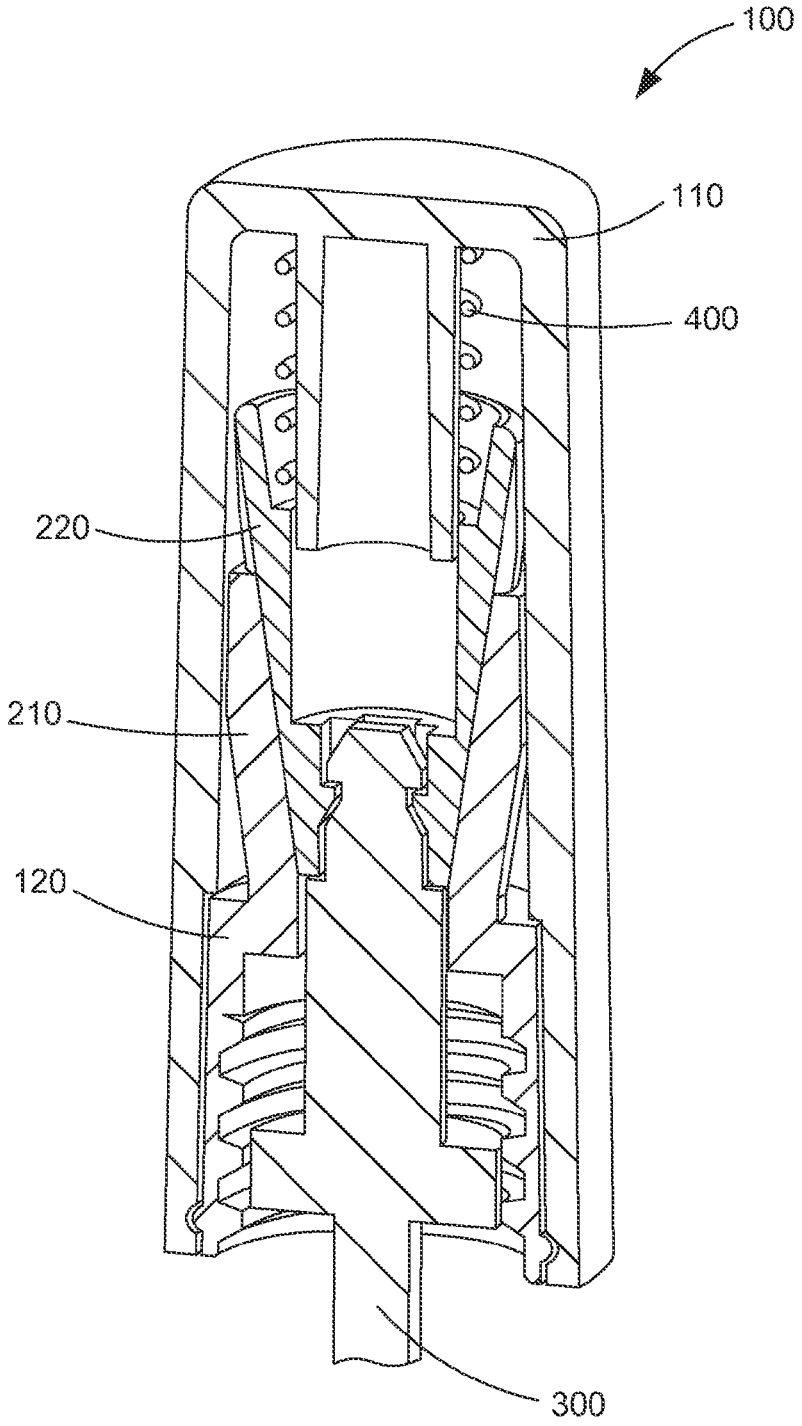
FIG. 1 is a cross-sectional view of a cap apparatus, with clutch engaged, in accordance with some embodiments described herein.
Figure 2:
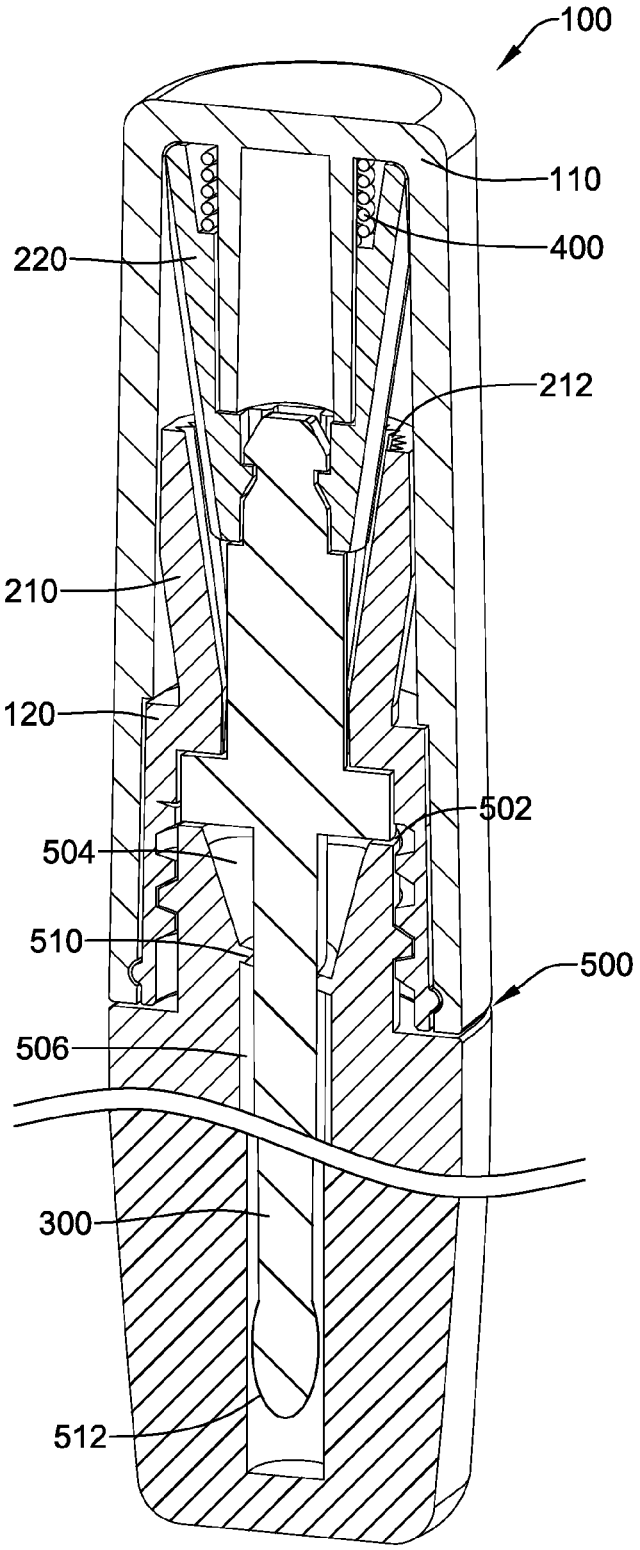
FIG. 2 is a cross-sectional view of a cap apparatus, with clutch disengaged, in accordance with some embodiments described herein.

Any suitable clutch mechanism may be used. Frictional clutches or those with mated and engaging toothed members may be used. Using typical language associated with clutches, a driving member engages a driven member, which is often, as here, associated with a shaft. As shown in FIGS. 1 and 2, a cone clutch is employed wherein an outer surface of the driven member engages an inner surface of the driving member. As seen in FIG. 2, the surfaces may optionally be provided with mated tooth members to facilitate strong contact between the driving member and the driven member. When engaged, the driving member and driven member act together.

With reference to FIGS. 1 and 2, a cap assembly is shown. The cap assembly 100 comprises an outer cap 110 and an inner cap 120. As depicted, the inner cap 120 is affixed within the outer cap 110 and comprises a driving member 210 of a clutch mechanism. A driven member 220 is affixed to the shaft 300 of a stemmed applicator (e.g., an applicator 512 as shown in FIG. 2), such that the shaft 300 and driven member 220 rotate with each other. As shown in FIG. 1, in some embodiments, a spring 400 is provided to urge the driven member 220 into engagement with the driving member 210. As will be appreciated, although any suitable mechanism for urging the driven member 220 into position may be used, a compression spring 400 is particularly well-suited to the task. One end of the spring 400 engages a stationary portion of the outer cap 110, such as the end wall, as shown in FIG. 1. The opposite end engages the driven member 220, such that when the cap is removed from the base (e.g., a base 500 as shown in FIG. 2), such as by twisting it open, the compression on the spring 400 is released, and the spring 400 urges the driven member 220 into contact with the driving member 210 such that the two engage, effectively holding the driven member 220 and attached shaft 300 in place. Thus, when the cap 100 is decoupled from the housing, such as in preparation for application of product, the stemmed applicator 512 is held firmly in place against rotation. In contrast, when the cap assembly is reinserted into the base 500 (thereby contacting an upper lip 502 of the base 500), and screwed into closed position, the spring 400 is compressed, allowing the driven member 220 and the driving member 210 to disengage from one another. In this disengaged position (FIG. 2), the driven member 220 and the attached shaft 300 rotate freely of the driving member 210 and attached outer cap 110. In this manner, the shaft does not rotate with the outer cap during insertion or removal. Since the shaft does not need to rotate within the wiper (e.g., wiper 510), any cross-sectional shaft shape and corresponding wiper 510 may be employed.

Any suitable clutch mechanism may be used. Frictional clutches or those with mated and engaging toothed members may be used. As shown in FIGS. 1 and 2, a cone clutch is employed wherein an outer surface of the driven member engages an inner surface of the driving member. As seen in FIG. 2, the surfaces may optionally be provided with mated tooth members (e.g., tooth members 212) to facilitate strong contact between the driving member and the driven member.

Existing applicators have been limited to shafts having a substantially circular cross-section. According to the description herein, the shaft of the stemmed applicator need not be limited to circular cross-sections. Any geometric cross-section is permissible, for example, but not limited to, cross-sectional shapes of circles, polygons, triangles, squares, pentagons, hexagons, heptagons, octagons, trapezoids, and other polygons, including regular polygons and irregular polygons, non-polygons (e.g., kidney shapes, crescents, infinity designs, half-circles, etc.). In each instance, the base can be provided with a wiper mechanism that mirrors the cross-sectional shape of the shaft to allow a close fit for wiping the shaft to remove excess product.

Figure 3:
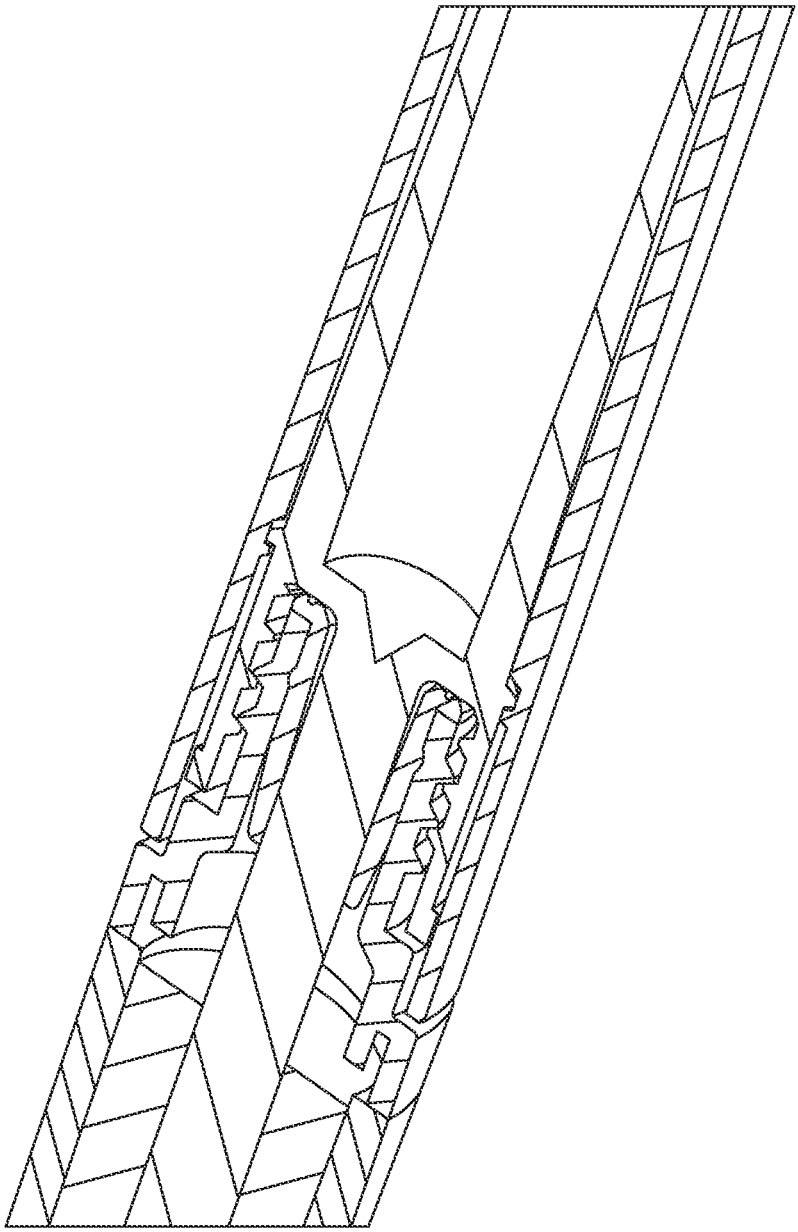
(PRIOR ART) FIG. 3
FIG. 3 is a cross-sectional view of a prior art, clutchless lip gloss applicator, depicting the cap and base including the wiper.

The base apparatus 500 may be any suitable apparatus, such as but not limited to a bottle, a canister, a tube, or other container. The base apparatus 500 is generally a housing that defines a reservoir (e.g., reservoir 506) for containing product to be applied and an opening 504 through which the stemmed applicator 512 is inserted and removed. In some embodiments, particularly those related to lip gloss and mascara, a wiper 510 is provided at the opening. The wiper 510 is generally made of a flexible, pliable material such as rubber, silicone, polypropylene or similar material that is easily deflected to adapt to the shape of an item passing therethrough. As shown in FIG. 3, depicting a standard lip gloss applicator device, the wiper is affixed at the opening in the housing and has a generally tapered flange which engages the sides of the shaft. In existing devices, the wiper is generally circular in cross-section (taken perpendicular to the longitudinal axis). In accordance with some embodiments described herein, the wiper 510 may be shaped to correspond to the non-circular shape of the shaft, thereby maintaining contact with the shaft 300 to preserve its functionality of wiping the shaft 300 and applicator 512 free of excess product. When the stemmed applicator 512 is removed, in some embodiments, the wiper 510 may substantially close against leaks and spillage.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "comprises" should be interpreted as "includes but is not limited to," etc.).

It should also be understood that although various compounds, compositions, methods, and devices are described in "open" terms of "comprising," "including," or "having" various components or steps (interpreted as meaning "including, but not limited to"), the compounds, compositions, methods, and devices can also "consist essentially of" or "consist of" the various components and steps, and such terminology should be interpreted as defining essentially closed-member groups. This paragraph is not meant in any way to limit the meaning of "comprising," "having," or "including" (and other verb forms thereof), which are to be interpreted as open-ended phrases meaning "including but not limited to" consistent with patent law and custom. The intent of this paragraph is merely to indicate that the closed-member groups defined by the "consisting of" or "consisting essentially of" language are lesser included groups within the open-ended descriptions and to provide support for claims employing the "consisting of" or "consisting essentially of" language.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

What is claimed is:

1. A dispenser apparatus comprising:

a base apparatus comprising a housing defining reservoir for holding product, and defining an opening, a wiper apparatus within the opening;

a cap assembly which is removably coupled to the base apparatus, the cap assembly comprising an outer cap, an inner cap affixed to an inner surface of the outer cap, a stemmed applicator assembly further comprising a shaft and an applicator, a clutch mechanism between the inner cap and the stemmed applicator;

wherein the clutch mechanism is engaged when the cap assembly is decoupled from the base apparatus to prevent rotation of the stemmed applicator with respect to the outer cap, and wherein the clutch mechanism is disengaged when the cap assembly is coupled to the base apparatus to permit independent rotation of the outer cap with respect to the shaft of the stemmed applicator.

2. The dispenser of claim 1, wherein the shaft of the stemmed applicator has a non-circular cross-section taken substantially perpendicular to a longitudinal axis of the shaft.

3. The dispenser of claim 1, wherein the shaft of the stemmed applicator has a cross-section, taken perpendicular to a longitudinal axis of the shaft, having a shape selected from a regular polygon, an irregular polygon, or a non-polygonal shape.

4. The dispenser of claim 1, wherein the shaft of the stemmed applicator has a cross-section, taken perpendicular to a longitudinal axis of the shaft, having a shape selected from a triangle, square, rectangle, pentagon, hexagon, heptagon, octagon or trapezoid.

5. The dispenser of claim 1, wherein the clutch mechanism is a friction clutch.

6. The dispenser of claim 1, wherein the clutch mechanism is a cone clutch.

7. The dispenser of claim 1, wherein the inner cap comprises a driving member of the clutch mechanism, and the stemmed applicator assembly comprises, at a proximal end, a driven member of the clutch mechanism.

8. The dispenser of claim 7, wherein the driving member and the driven member comprise mated and engaging tooth members.

9. The dispenser of claim 7, wherein the cap assembly is further provided with at least one spring urging the driving member and driven member towards each other when the base assembly and cap assembly are decoupled.

10. The dispenser of claim 9, wherein the base apparatus and the cap assembly are threaded to facilitate closing and opening of the dispenser, and the base apparatus further comprises an upper lip for engaging the stemmed applicator assembly such that the clutch is disengaged prior to threaded coupling of the base apparatus and the cap assembly.

11. A cap assembly adapted for removable coupling to a base apparatus, the cap assembly comprising:

an outer cap, an inner cap affixed to an inner surface of the outer cap, a stemmed applicator assembly further comprising a shaft, a clutch mechanism between the inner cap and the stemmed applicator assembly;

wherein the clutch mechanism is engaged when the cap assembly is decoupled from the base apparatus to prevent rotation of the stemmed applicator with respect to the outer cap, and wherein the clutch mechanism is disengaged when the cap assembly is coupled to the base apparatus to permit independent rotation of the outer cap with respect to the shaft of the stemmed applicator.

12. The cap assembly of claim 11, wherein the shaft of the stemmed applicator has a non-circular cross-section taken substantially perpendicular to a longitudinal axis of the shaft.

13. The cap assembly of claim 11, wherein the shaft of the stemmed applicator has a cross-section, taken perpendicular to a longitudinal axis of the shaft, having a shape selected from a regular polygon, an irregular polygon, or a non-polygonal shape.

14. The cap assembly of claim 11, wherein the shaft of the stemmed applicator has a cross-section, taken perpendicular to a longitudinal axis of the shaft, having a shape selected from a triangle, square, rectangle, pentagon, hexagon, heptagon, octagon or trapezoid.

15. The cap assembly of claim 11, wherein the clutch mechanism is a friction clutch.

16. The cap assembly of claim 11, wherein the clutch mechanism is a cone clutch.

17. The cap assembly of claim 11, wherein inner cap comprises a driving member of the clutch mechanism, and the stemmed applicator assembly comprises, at a proximal end, a driven member of the clutch mechanism.

18. The cap assembly of claim 17, wherein the driving member and the driven member comprise mated and engaging tooth members.

19. The cap assembly of claim 17, wherein the cap assembly is further provided with at least one spring urging the driving member and driven member towards each other when the base assembly and cap assembly are decoupled.

20. A dispenser comprising the cap assembly of claim 19 and a base apparatus for use therewith, wherein the base apparatus and the cap assembly are threaded to facilitate closing and opening of the dispenser, and the base apparatus further comprises an upper lip for engaging the stemmed applicator assembly such that the clutch is disengaged prior to threaded coupling of the base apparatus and the cap assembly.

* * * * *